US008971771B2

(12) United States Patent
Akedo

(10) Patent No.: US 8,971,771 B2
(45) Date of Patent: Mar. 3, 2015

(54) INTERMEDIATE HOPPER AND IMAGE FORMING APPARATUS

(71) Applicant: Sharp Kabushiki Kaisha, Osaka-shi, Osaka (JP)

(72) Inventor: Shuichi Akedo, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 40 days.

(21) Appl. No.: 13/756,643

(22) Filed: Feb. 1, 2013

(65) Prior Publication Data

US 2013/0202329 A1 Aug. 8, 2013

(30) Foreign Application Priority Data

Feb. 2, 2012 (JP) ..... 2012-020891

(51) Int. Cl.
*G03G 15/08* (2006.01)

(52) U.S. Cl.
CPC ..... *G03G 15/0822* (2013.01); *G03G 15/0893* (2013.01); *G03G 15/0877* (2013.01)
USPC ..... 399/258; 399/256

(58) Field of Classification Search
CPC ..... G03G 15/0822
USPC ..... 399/254, 256, 258
See application file for complete search history.

(56) References Cited

U.S. PATENT DOCUMENTS 5,495,320 A * 2/1996 Araki et al. ..... 399/256
6,035,168 A * 3/2000 Masuda et al. ..... 399/254
7,039,344 B2 * 5/2006 Nishiyama ..... 399/254
7,627,260 B2 * 12/2009 Shiraishi et al. ..... 399/254 X
7,702,261 B2 * 4/2010 Yasuda ..... 399/254
7,848,664 B2 * 12/2010 Suenaga et al. ..... 399/258 X
7,933,539 B2 4/2011 Kubota et al.
8,014,704 B2 * 9/2011 Matsumoto et al. ..... 399/258
8,055,164 B2 * 11/2011 Saito et al. ..... 399/254 X
2007/0217827 A1 9/2007 Tsuji et al.
2008/0025762 A1 1/2008 Takayama
2012/0014719 A1 * 1/2012 Hayashi et al. ..... 399/254

FOREIGN PATENT DOCUMENTS

JP 09-211983 8/1997
JP 2001-343825 12/2001
JP 2005-91715 4/2005
JP 2007-256393 10/2007
JP 2008-33183 2/2008

* cited by examiner

*Primary Examiner* — Sandra Brase
(74) *Attorney, Agent, or Firm* — Nixon & Vanderhye P.C.

(57) ABSTRACT

An intermediate hopper has a toner reception tub, a partition for dividing an internal space of the toner reception tub; a first and a second toner conveyance path; a first toner conveyance screw being provided in the first toner conveyance path; a second toner conveyance screw being provided in the second toner conveyance path; a toner receiving port for receiving the toner; a toner communicating path for guiding the toner in the first toner conveyance path to the second toner conveyance path; a toner discharge port; and a toner amount detection sensor, wherein the first toner conveyance screw further comprises an agitation plate disposed at a position facing the toner receiving port so as to extend radially from the first rotation axis and fixed in parallel with the first rotation axis, and the toner amount detection sensor is provided on an upstream side relative to the agitation plate.

2 Claims, 10 Drawing Sheets

INTERMEDIATE HOPPER AND IMAGE FORMING APPARATUS

CROSS-REFERENCE TO RELATED APPLICATIONS

This application is related to Japanese application No. 2012-020891 filed on 2 Feb. 2012 whose priority is claimed under 35 USC §119, the disclosure of which is incorporated by reference in its entirety.

BACKGROUND OF THE INVENTION

1. Field of the Invention

The present invention relates to an intermediate hopper and an image forming apparatus. More particularly, the present invention relates to an intermediate hopper for temporarily containing toner to be supplied to a developing device and an image forming apparatus such as an electrostatic copying machine, a laser printer and a facsimile machine that forms images by an electrophotographic method by guiding the toner contained in the intermediate hopper to the developing device.

2. Description of the Related Art

In the image forming apparatus using the electrophotographic method, an electrostatic latent image is formed on a surface of a photoconductor drum (toner image holder), toner is supplied to the photoconductor drum by means of a developing device to develop the electrostatic latent image, a toner image formed on the photoconductor drum through the development is transferred onto a sheet such as a paper sheet, and the toner image is fixed onto the sheet by means of a fixing device.

Since the toner is consumed at every image formation, the developing device is replenished with toner stored in a toner cartridge. Nowadays, there is an image forming apparatus available which employs an intermediate hopper for temporarily containing toner instead of supplying the toner directly from a toner cartridge to a developing device.

In this image forming apparatus, the toner stored in the toner cartridge is supplied to the intermediate hopper, and the toner supplied to the intermediate hopper is supplied to the developing device.

The intermediate hopper includes a toner reception tub for containing a toner, and the toner reception tub is provided with a toner amount detection sensor for checking presence or absence of the toner supplied to the intermediate hopper.

With such an intermediate hopper, even when the toner in the cartridge runs out, it is possible to secure the time needed to remove the empty toner cartridge and replace it with a new toner cartridge without suspending a printing operation in the image forming apparatus, because the intermediate hopper contains the toner.

That is, with the intermediate hopper, it is possible to continue an image formation operation during the replacement of the toner cartridge (referred to as continuous run).

For example, Japanese Unexamined Patent Application Publication No. 2009-251169 proposes an intermediate toner hopper comprising: a container tank for temporarily containing toner discharged from a toner bottle; and two carrying screws arranged in the container tank so that axis lines thereof are parallel to each other for carrying the toner in opposite directions by rotating in opposite directions, wherein the toner discharged from the toner bottle is received through a toner supply opening formed in the container tank and temporarily contained, guided toward a toner discharge opening formed in the container tank while being circulated and carried by the rotation of the two carrying screws, and then discharged into a developing device through the toner discharge opening (see FIGS. 1 and 4, and paragraphs 0056 to 0067).

While being able to discharge some of the toner being circulated and carried inside the container tank swiftly by using the two carrying screws, the conventional intermediate toner hopper as described above is disadvantageous in that the toner stays at an end of the container tank, because the two carrying screws do not have a partition therebetween.

In addition, when the toner is carried under agitation by the carrying screws and the flowability of the toner is decreased for some reason, there may be generated a region having a locally decreased toner density. In this case, the above-mentioned toner amount detection sensor for detecting presence or absence of the toner may detect such a region having a decreased toner density to falsely conclude that no toner is remaining.

As a result, despite the fact that the toner is remaining in the intermediate toner hopper, toner will be supplied from a toner supplying device to a toner receiving port of the intermediate toner hopper based on the conclusion that no toner is remaining, and therefore the toner gets stuck at the toner receiving port of the intermediate toner hopper (referred to as toner bridging).

Due to the toner bridging, disadvantageously, the toner cannot be supplied to the developing device, prevented from being carried normally in the intermediate toner hopper.

In addition, if supply of toner from the toner bottle is suspended for replacement of the toner bottle while the toner is circulated and carried in the intermediate toner hopper, the toner carrying paths will have a region having no toner or a region having a low toner density (hereinafter, referred to as toner-missing space).

The toner-missing space is also carried toward the toner discharge opening with the toner carried by the carrying screws. When the toner-missing space reaches the toner discharge opening, the supply of the toner to the developing device is suspended to reduce the toner density in the developing device. The toner thus supplied unsteadily and nonuniformly may cause an uneven image.

SUMMARY OF THE INVENTION

The present invention is an intermediate hopper comprising: a toner reception tub for containing a toner; a partition for dividing an internal space of the toner reception tub; a first toner conveyance path and a second toner conveyance path separated by the partition; a first toner conveyance screw being provided in the first toner conveyance path and comprising a first rotation axis and a first helical blade fixed to the first rotation axis; a second toner conveyance screw being provided in the second toner conveyance path and comprising a second rotation axis and a second helical blade fixed to the second rotation axis; a toner receiving port provided on an upstream side of the first toner conveyance path for receiving the toner into the toner reception tub; a toner communicating path for communicating a downstream end of the first toner conveyance path and an upstream end of the second toner conveyance path, and guiding the toner in the first toner conveyance path to the second toner conveyance path; a toner discharge port provided on a downstream side of the second toner conveyance path for discharging the toner out of the toner reception tub; and a toner amount detection sensor for detecting presence or absence of the toner in the first toner conveyance path, wherein the first toner conveyance screw further comprises an agitation plate disposed at a position facing the toner receiving port so as to extend radially from the first rotation axis and fixed in parallel with the first rotation axis, and the toner amount detection sensor is provided on an upstream side relative to the agitation plate.

Since the agitation plate is provided at a position facing the toner receiving port, and the toner amount detection sensor is provided on an upstream side relative to the agitation plate, the toner supplied through the toner receiving port is temporarily accumulated, and the toner amount detection sensor detects the toner accumulated without a gap. According to the configuration, therefore, it is possible to accurately detect presence or absence of the toner and to prevent false detection of the toner in the intermediate hopper.

In addition, since it is possible to accurately detect presence or absence of the toner, toner bridging, which occurs around the toner receiving port due to false detection of toner in a conventional hopper, is prevented, and therefore the toner can be supplied to the developing device without failure.

BRIEF DESCRIPTION OF THE DRAWINGS

FIG. 10(*b*) is an explanatory diagram illustrating the example of toner conveyance in the intermediate hopper of the present invention;

DESCRIPTION OF THE PREFERRED EMBODIMENTS

Figure 1:
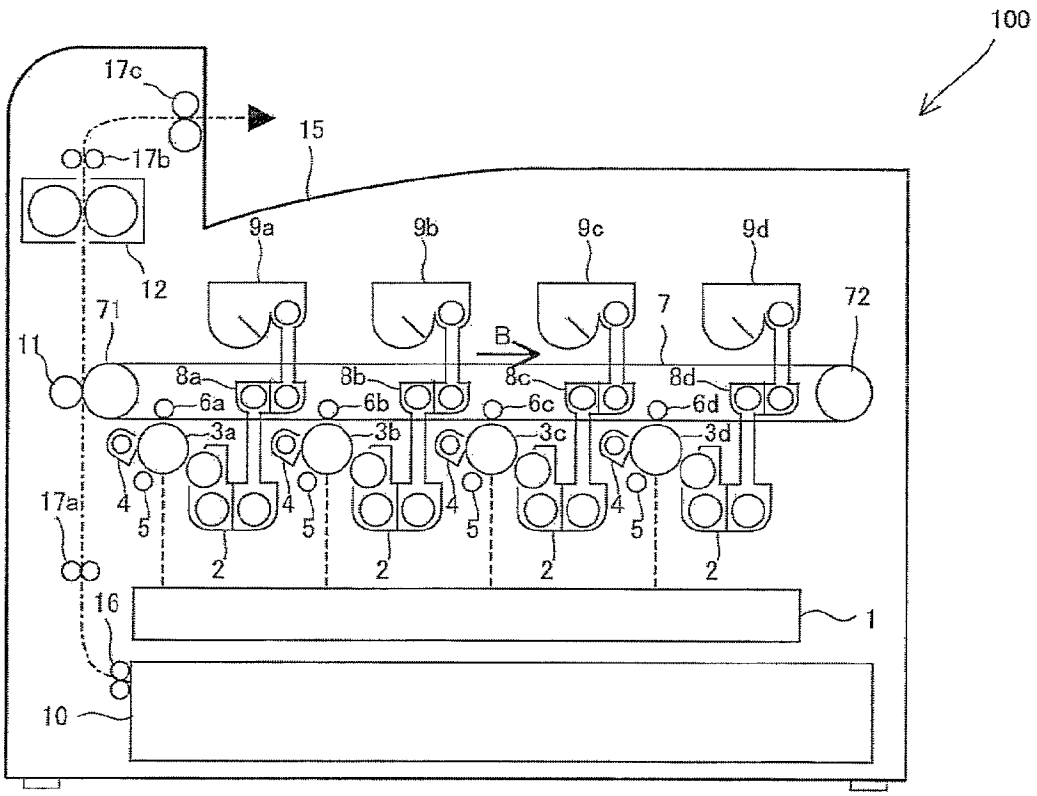
FIG. 1 is a schematic configuration diagram of an embodiment of an image forming apparatus of the present invention.

The present invention provides an intermediate hopper that prevents false detection of toner in the intermediate hopper and allows steady supply of toner to a developing device even when supply of toner from a toner cartridge (toner supplying device) is not sufficient during replacement of the toner cartridge, and an image forming apparatus including the intermediate hopper.

In the intermediate hopper of this invention, the partition comprises an intermediate slit for guiding the toner contained in the first toner conveyance path to the second toner conveyance path.

According to the configuration, even when a toner-missing space is generated in any of the toner conveyance paths of the intermediate hopper while a toner supplying device is being replaced without suspending an image formation process, for example, toner can be supplied to the toner-missing space through the intermediate slit provided to the partition separating the first and second toner conveyance paths to swiftly fill the toner-missing space and allow steady toner supply to a developing device.

In the intermediate hopper of this invention, the first toner conveyance screw rotates in a direction in which an outer edge of the first toner conveyance screw moves toward the second toner conveyance path at a lowermost point, and the second toner conveyance screw rotates in a direction in which an outer edge of the second toner conveyance screw moves away from the first toner conveyance path at a lowermost point.

According to the configuration, the first toner conveyance screw rotates to urge the toner in the first toner conveyance path toward the second toner conveyance path, that is, toward the partition in the first toner conveyance path, and therefore the toner around the intermediate slit out of the toner in the first toner conveyance path is caused to move to the second toner conveyance path through the intermediate slit.

In addition, the second toner conveyance screw rotates to urge the toner in the second toner conveyance path away from the first toner conveyance path, that is, away from the partition in the second toner conveyance path, and therefore the toner around the intermediate slit out of the toner in the second toner conveyance path is prevented from flowing backward from the second toner conveyance path to the first toner conveyance path.

In the intermediate hopper of this invention, the intermediate slit is formed at a position where the outer edges of the helical blades of the first toner conveyance screw and the second toner conveyance screw come closest to each other.

At the position of the intermediate slit where the outer edges of the helical blades of the first and second toner conveyance screws come closest to each other, the first toner conveyance screw urges the toner in the first toner conveyance path toward the partition, and at the same time, the second toner conveyance screw urges the toner in the second toner conveyance path away from the partition. According to the configuration, therefore, the toner can be caused to swiftly move from the first toner conveyance path to the second toner conveyance path.

The present invention is an image forming apparatus comprising: a photoconductor drum having a surface on which an electrostatic latent image is formed; a charger for charging the surface of the photoconductor drum; an exposure device for forming the electrostatic latent image on the surface of the photoconductor drum; a developing device for supplying a toner to the electrostatic latent image on the surface of the photoconductor drum to form a toner image; the intermediate hopper according to any one of claims 1 to 4 for supplying the toner to the developing device; a toner supplying device for supplying the toner to the intermediate hopper; a transfer device for transferring the toner image on the surface of the photoconductor drum onto a recording medium; and a fixing device for fixing the transferred toner image on the recording medium.

According to the configuration, it is possible to accurately detect presence or absence of the toner in the intermediate hopper, and besides it is possible to swiftly fill a toner-missing space which can be generated in the intermediate hopper during replacement of the toner supplying device. Therefore, it is possible to steadily supply the toner to the developing device and to form stable quality images for a long period of time.

Hereinafter, embodiments of a developing device and an image forming apparatus of the present invention will be described in detail with reference to the drawings. It should be noted that the present invention is not limited thereto.

[Configuration of Image Forming Apparatus]

FIG. 1 is an explanatory diagram illustrating a general configuration of an embodiment of an image forming apparatus including an intermediate hopper according to the present invention.

The image forming apparatus 100 forms a multicolor or monochrome image on a sheet-like recording medium (recording paper) according to image data transmitted from an external source.

In the embodiment in FIG. 1, the image forming apparatus is a full-color printer by way of example. Alternatively, the image forming apparatus may be a copying machine, a facsimile machine or a multifunctional system having these functions which can form a multicolor or monochrome image on a recording medium according also to externally-transmitted image data and/or image data scanned from a document by a scanner.

The image forming apparatus 100 comprises: four photoconductor drums 3*a* to 3*d*; four chargers (charging devices) 5*a* to 5*d* for charging surfaces of the respective photoconductor drums 3*a* to 3*d*; a laser scanner unit (exposure device) 1 for applying laser light to the surfaces of the respective photoconductor drums 3*a* to 3*d* to form electrostatic latent images; four developing devices 2*a* to 2*d* for individually containing black, cyan, magenta and yellow toners and developing the electrostatic latent images on the surfaces of the respective photoconductor drums 3*a* to 3*d* to form toner images; four cleaner units 4*a* to 4*d* for removing residual toners left on the surfaces of the respective photoconductor drums 3*a* to 3*d* after the development and the image transfer; four intermediate hoppers 8*a* to 8*d* for individually supplying the toners of the four colors to the respective developing devices 2*a* to 2*d*; four toner supplying devices (toner cartridges) 9*a* to 9*d* for individually supplying the toners of the four colors to the respective intermediate hoppers 8*a* to 8*d*; an intermediate transfer belt 7 onto which the toner images on the surfaces of the respective photoconductor drums 3*a* to 3*d* are transferred; a transfer device having intermediate transfer rollers 6*a* to 6*d* for transferring the toner images on the surfaces of the respective photoconductor drums 3*a* to 3*d* onto a surface of the intermediate transfer belt 7 and a transfer roller 11 for transferring the toner images on the surface of the intermediate transfer belt 7 onto a recording medium; a sheet feed tray 10 for containing the recording medium; a pickup roller 16 for picking up the recording medium from the sheet feed tray 10; a conveyance roller 17*a* for conveying the recording medium from the sheet feed tray 10 to the transfer roller 11; a fixing device 12 for fusing the toner images transferred on the recording medium; conveyance rollers 17*b* and 17*c* for conveying the recording medium from the fixing device 12 to the outside of the image forming apparatus 100; and so on.

A top surface of the image forming apparatus 100 serves as a sheet exit tray 15.

The transfer device includes an intermediate transfer belt driving roller 71, an intermediate transfer belt driven roller 72 and an intermediate transfer belt tension mechanism, not shown, in addition to the transfer roller 11, the intermediate transfer rollers 6 (6*a*, 6*b*, 6*c* and 6*d*) and the intermediate transfer belt 7.

The intermediate transfer roller 6, the intermediate transfer belt driving roller 71, the intermediate transfer belt driven roller 72 and the intermediate transfer belt tension mechanism allow the intermediate transfer belt 7 to be laid across in a tensioned condition, and allow the intermediate transfer belt 7 to be driven to rotate in an arrow B direction in FIG. 1.

The reference numerals with a represent members for black image formation, the reference numerals with b represent members for cyan image formation, the reference numerals with c represent members for magenta image formation, and the reference numerals with d represent members for yellow image formation (except the conveyance rollers).

In the image forming apparatus 100, a black toner image, a cyan toner image, a magenta toner image and a yellow toner image are selectively formed on the surfaces of the photoconductor drums 3*a*, 3*b*, 3*c* and 3*d* based on image data of the four color components of black (K), cyan (C), magenta (M) and yellow (Y), respectively. The toner images formed are superimposed on each other on the intermediate transfer belt 7 to form one color image on a recording medium.

Hereinafter, the photoconductor drums 3*a* to 3*d* corresponding to the respective colors will be collectively described with a reference numeral 3 as having the same configuration. Likewise, the developing devices will be denoted by a reference numeral 2, the chargers will be denoted by a reference numeral 5, the cleaner units will be denoted by a reference numeral 4, the intermediate hoppers will be denoted by a reference numeral 8, and the toner supplying devices will be denoted by a reference numeral 9 in the following description.

[Configuration of Developing Device 2]

Figure 2:
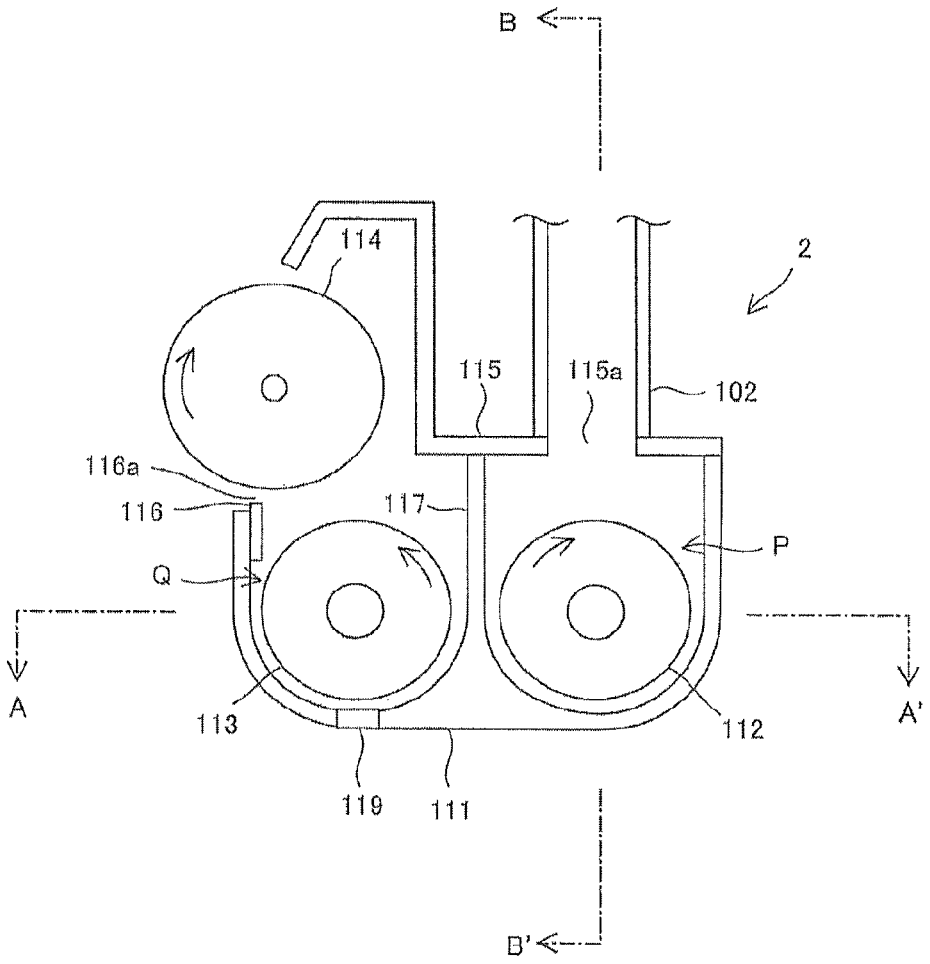
FIG. 2 is a sectional view illustrating a schematic configuration of an embodiment of a developing device of the present invention.
Figure 3:
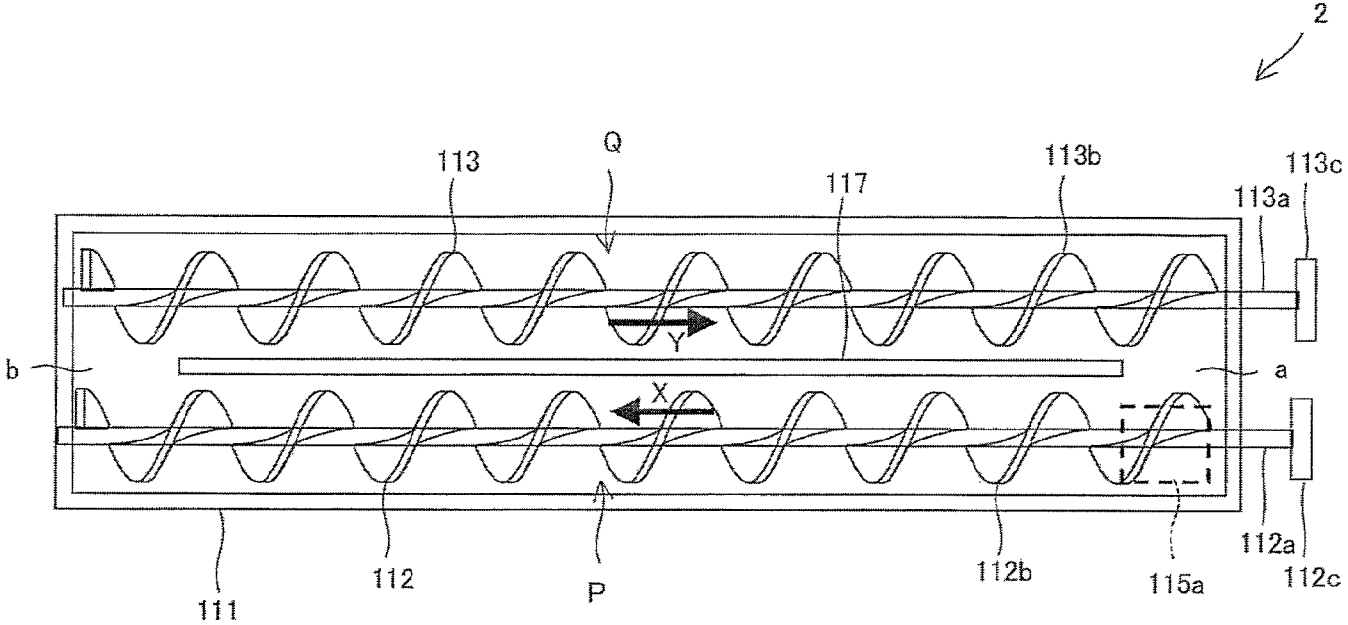
FIG. 3 is a sectional view of the developing device taken along a line A-A' in FIG. 2.
Figure 4:
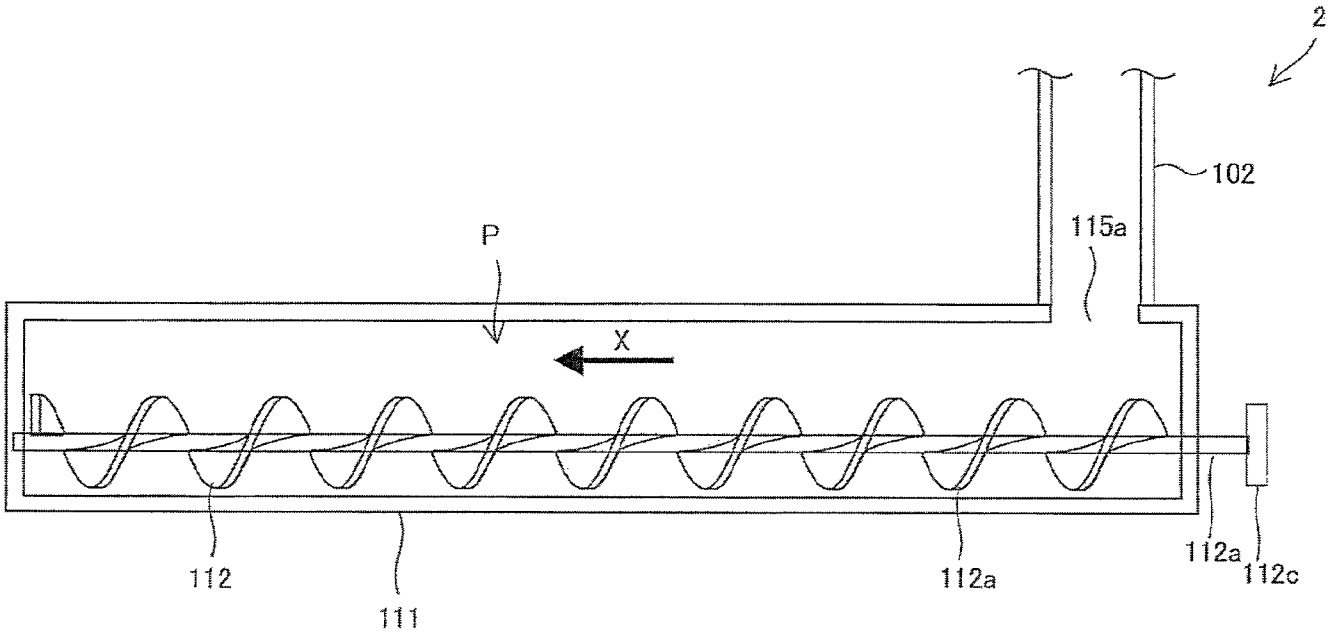
FIG. 4 is a sectional view of the developing device taken along a line B-B' in FIG. 2.

FIG. 2 is a sectional view illustrating an embodiment of the developing device 2 illustrated in FIG. 1. FIG. 3 is a sectional view of the developing device 2 taken along a line A-A' in FIG. 2. FIG. 4 is a sectional view of the developing device 2 taken along a line B-B' in FIG. 2. In these drawings, a developer stored in a developer tank 111 is not shown.

The developing device 2 has, in the developer tank 111, a developing roller 114 disposed so as to oppose the photoconductor drum 3. The developing device 2 supplies toner to the surface of the photoconductor drum 3 by means of the developing roller 114 to develop (make visible) an electrostatic latent image formed on the surface of the photoconductor drum 3.

The developing device 2 includes the developer tank 111, the developing roller 114 for supplying a two-component developer to the photoconductor drum 3, a partition 117, developer conveyance members 112 and 113, a doctor blade 116, and a toner concentration detection sensor 119.

The developer tank 111 contains a developer including a toner and a magnetic carrier (two-component developer). The developer tank 111 has a detachable developer tank cover 115 that constitutes an upper wall thereof.

In the developer tank 111, the developing roller 114, the first conveyance member 112, the second conveyance member 113 and the doctor blade 116 are arranged at positions as illustrated in FIG. 2.

The carrier included in the developer usable for the present invention is a magnetic carrier having magnetism such as, for example, a ferrite carrier.

<<Internal Configuration of Developer Tank>>

The internal space of the developer tank 111 is divided into two chambers lying side by side in the horizontal direction by the partition 117 whose cross section parallel to the axial direction of the development roller 114 is U-shaped. Out of the two chambers, the right chamber in FIG. 2 is a first developer conveyance path P, and the left chamber in FIG. 2 under the developing roller 114 is a second developer conveyance path Q.

The first conveyance member 112 and the second conveyance member 113 are rotatably provided to the first developer conveyance path P and the second developer conveyance path Q, respectively.

As illustrated in FIG. 3, a first communicating path a is provided near an end of the partition 117 (plate separating the first developer conveyance path P from the second developer conveyance path Q) for guiding the two-component developer from the second developer conveyance path Q to the first developer conveyance path P. Likewise, as illustrated in FIG. 3, a second communicating path b is formed at the other end of the partition 117 opposite to the first communicating path a for guiding the two-component developer from the first developer conveyance path P to the second developer conveyance path Q.

That is, as illustrated in FIG. 3, the first developer conveyance path P and the second developer conveyance path Q are communicated with each other by the first communication path a and the second communication path b which are provided on both the sides in the axial direction.

Thus, the first and second developer conveyance paths P and Q, and the first and second communicating paths a and b form a circular developer conveyance path for cyclically conveying the developer.

In addition, as illustrated in FIG. 3, the developer is conveyed in an arrow X direction in the first developer conveyance path P, and the developer is conveyed in an arrow Y direction in the second developer conveyance path Q.

The developer tank cover 115 is provided with a toner supply port 115*a* at an upstream side of the developer conveyance direction in the first developer conveyance path P as illustrated in FIG. 3. Unused new toner is supplied from the intermediate hopper to the developing device through the toner supply port 115*a*.

<<Developing Roller>>

As illustrated in FIG. 2, the developer tank 111 has an opening formed at an upper part of the second developer conveyance path Q. In the opening, the developing roller 114 is rotatably disposed so as to have a predetermined development nip part between the developing roller 114 and the photoconductor drum 3.

The developing roller 114 is a magnet roller to be driven by drive means, not shown, to rotate about its axis for bearing and supplying the two-component developer in the second developer conveyance path Q to the photoconductor drum 3. A development bias voltage is applied from a power supply, not shown, to cause toner to adhere to an electrostatic latent image on the surface of the photoconductor drum 3 to develop the image.

<<Doctor Blade>>

As illustrated in FIG. 2, the doctor blade 116 is a rectangular plate-like member extending in parallel with the axial direction of the developing roller 114. A lower part thereof is fixed to a lower end of the opening for the developer tank 111 while an upper end 116*a* thereof is separated from the surface of the developing roller 114 with a predetermined gap. Examples of the material of the doctor blade 116 include stainless steel, aluminum and synthetic resin.

As illustrated in FIG. 3, the first conveyance member 112 comprises an auger screw including a first rotation axis 112*a* and a first helical conveyance blade 112*b* fixed to the first rotation axis 112*a* to integrally rotate. The first conveyance member 112 includes a first gear 112*c* at one end of the rotation axis 112*a* that penetrates a side wall on the right side of the longitudinal direction of the developer tank 111.

The first conveyance member 112 is rotationally driven by a drive motor, not shown, and conveys, while agitating, the two-component developer in the first developer conveyance path P in the arrow X direction in FIG. 3.

As illustrated in FIG. 3, the second conveyance member 113 comprises an auger screw including a second rotation axis 113*a* and a second helical conveyance blade 113*b* fixed to the second rotation axis 113*a* to integrally rotate. The second conveyance member 113 includes a second gear 113*c* at one end of the rotation axis 113*a* that penetrates the side wall on the right side of the longitudinal direction of the developer tank 111.

The second conveyance member 113 is rotationally driven by a drive motor, not shown, and conveys, while agitating, the two-component developer in the second developer conveyance path Q in the arrow Y direction in FIG. 3.

<<Toner Concentration Detection Sensor>>

As illustrated in FIG. 2, the toner concentration detection sensor 119 is provided under the second conveyance member 113 in the vertical direction and in an approximate center of the second developer conveyance path Q. The sensor is attached to a semi-cylindrical inner wall surface of the developer tank 111 that forms the second developer conveyance path Q and provided so that its sensing surface is exposed on the inside of the second developer conveyance path Q at a position where it contacts with the developer in the second developer conveyance path Q.

The toner concentration detection sensor 119 is electrically connected to a toner concentration control unit, not shown.

The toner concentration control unit exerts control according to a toner concentration measurement value detected by the toner concentration detection sensor 119 so that the intermediate hopper 8 to be described later is driven to supply the toner into the first developer conveyance path P of the developing device 2 through the toner supply port 115*a*.

When the toner concentration control unit determines that the toner concentration measurement value detected by the toner concentration detection sensor 119 is lower than a predetermined value, a control signal is transmitted to drive means that drives the intermediate hopper 8, so that the toner is discharged from the intermediate hopper 8.

Examples of the toner concentration detection sensor 119 usable here include general toner concentration detection sensors such as a transmitted light detection sensor, a reflected light detection sensor and a magnetic permeability detection sensor. In particular, the magnetic permeability detection sensor is preferable in terms of sensitivity.

The magnetic permeability detection sensor (toner concentration detection sensor 119) is connected to a power supply, not shown.

The power supply applies a driving voltage to the magnetic permeability detection sensor to drive the magnetic permeability detection sensor. The power supply also applies a control voltage to the magnetic permeability detection sensor to output a toner concentration detection result to the toner concentration control unit. The voltage application to the magnetic permeability detection sensor from the power supply is controlled by the toner concentration control unit.

[Configuration of Toner Supplying Device]

Figure 11:
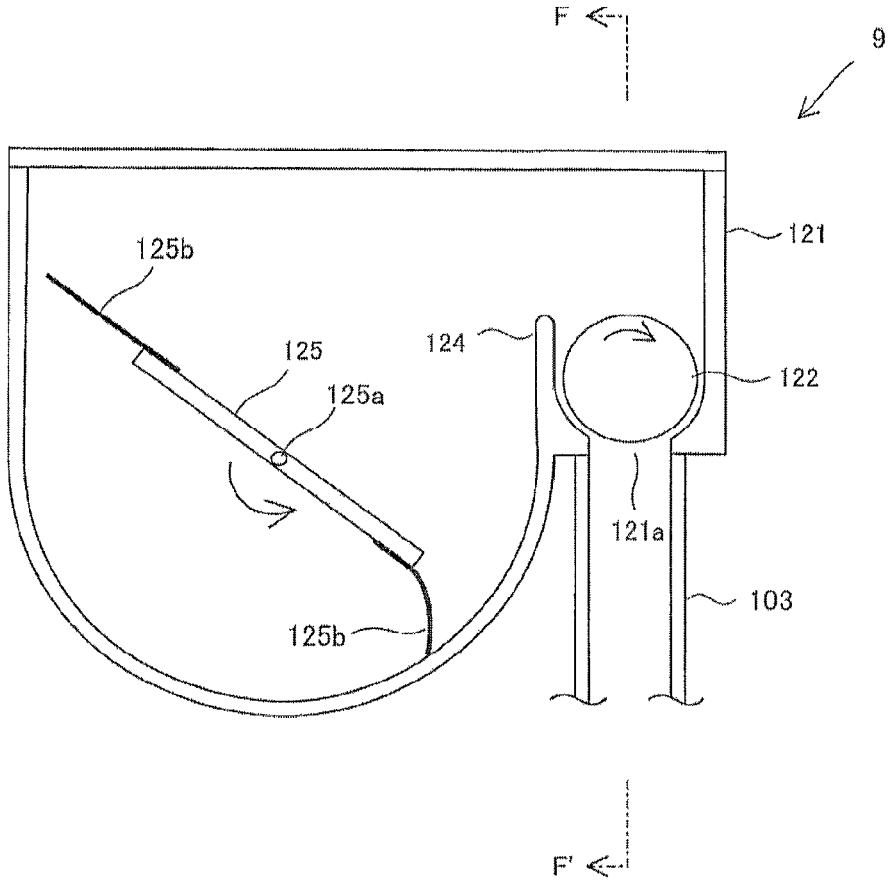
FIG. 11 is a sectional view illustrating a schematic configuration of an embodiment of a toner supplying device of the present invention.
Figure 12:
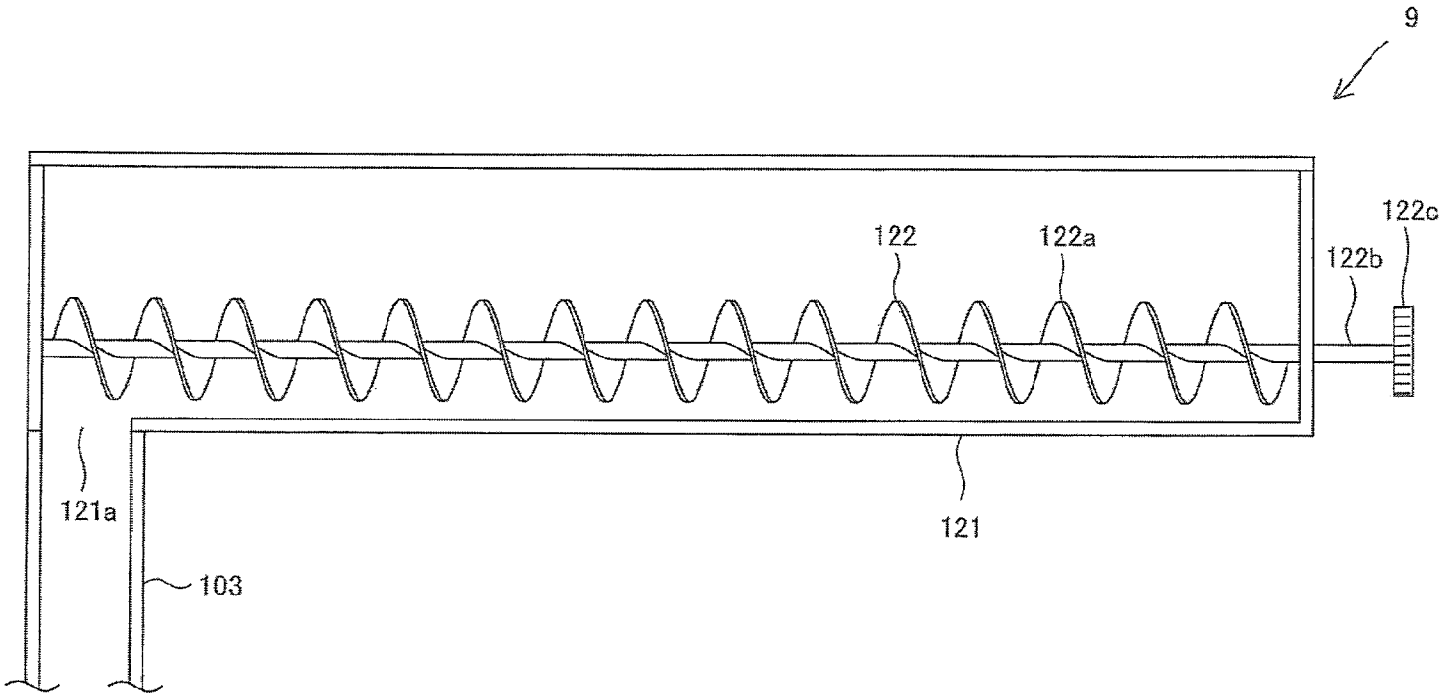
FIG. 12 is a sectional view of the toner supplying device taken along a line F-F' in FIG. 11.

FIG. 11 is a schematic sectional view illustrating an embodiment of the toner supplying device of the present invention. FIG. 12 is a sectional view of the toner supplying device, illustrating a section around a toner discharge port taken along a line F-F' in FIG. 11.

As illustrated in FIGS. 11 and 12, the toner supplying device 9 includes a toner container 121 having a toner discharge port 121*a*, a toner agitation member 125 and a toner discharge member 122, and contains unused toner in the container.

As illustrated in FIG. 1, the toner supplying device 9 is disposed above the intermediate hopper 8, and the toner discharge port 121*a* and a toner receiving port 215*a* (see FIG. 5) of the intermediate hopper 8 are connected via a toner conveyance pipe 103 connected to an upper end portion of the toner receiving port. The toner container 121 is a substantially semi-cylindrical container having an internal space, and the toner discharge port 121*a* is disposed at a lateral position in a circumferential direction of the semi-cylindrical part.

The toner agitation member 125 is rotatably disposed at a substantially central position in the semi-cylindrical part of the toner container 121, and the toner discharge member 122 is rotatably disposed above and near the toner discharge port 121*a*.

The toner agitation member 125 is a plate-like member that rotates about a rotation axis 125*a*, and the toner agitation member 125 has sheet-like toner drawing members 125*b* made of flexible resin (for example, polyethylene terephthalate) at both leading ends away from the rotation axis 125*a*. The rotation axis 125*a* is rotatably supported on sidewalls on both sides in the longitudinal direction of the toner container 121, and one end of the rotation axis 125*a* penetrates the sidewall and has a gear fixed thereto and being in meshing engagement with a drive gear of drive means, not shown.

Upward rotation of the toner drawing members 125*b* with respect to the toner discharge port 121*a* causes the toner agitation member 125 to simultaneously agitate and draw the toner contained in the toner container 121 to convey the toner to the toner discharge member 122.

On this occasion, the toner drawing members 125*b* rotate to supply the toner to the side of the toner discharge member 122 while sliding along the inside wall of the toner container 121 and being deformed due to its flexibility.

The toner discharge member 122 and the toner agitation member 125 have a partition 124 therebetween. Thereby, an appropriate amount of toner drawn by the toner agitation member 125 can be held around the toner discharge member 122.

The toner discharge member 122 supplies the toner in the toner container 121 to the intermediate hopper 8 through the toner discharge port 121*a*. As illustrated in FIG. 12, the toner discharge member 122 includes a rotation axis 122*b* whose both ends are rotatably supported on sidewalls on both sides in the longitudinal direction of the toner container 121, a helical blade 122*a* fixed to the outer circumferential surface of the rotation axis 122*b* and a gear 122*c* fixed to the rotation axis 122*b* at one end that penetrates the sidewall of the toner container 121. The gear 122*c* is in meshing engagement with a drive gear of drive means, not shown.

The toner discharge port 121*a* of the toner container 121 is disposed at one end side of the helical blade 122*a* opposite to the side of the gear 122*c*.

Rotation of the toner discharge member 122 causes the toner supplied around the toner discharge member 122 to be conveyed by the helical blade 122*a* toward the toner discharge port 121*a* and to be supplied from the toner discharge port 121*a* into the intermediate hopper 8 through the toner conveyance pipe 103.

[Configuration of Intermediate Hopper]

Figure 5:
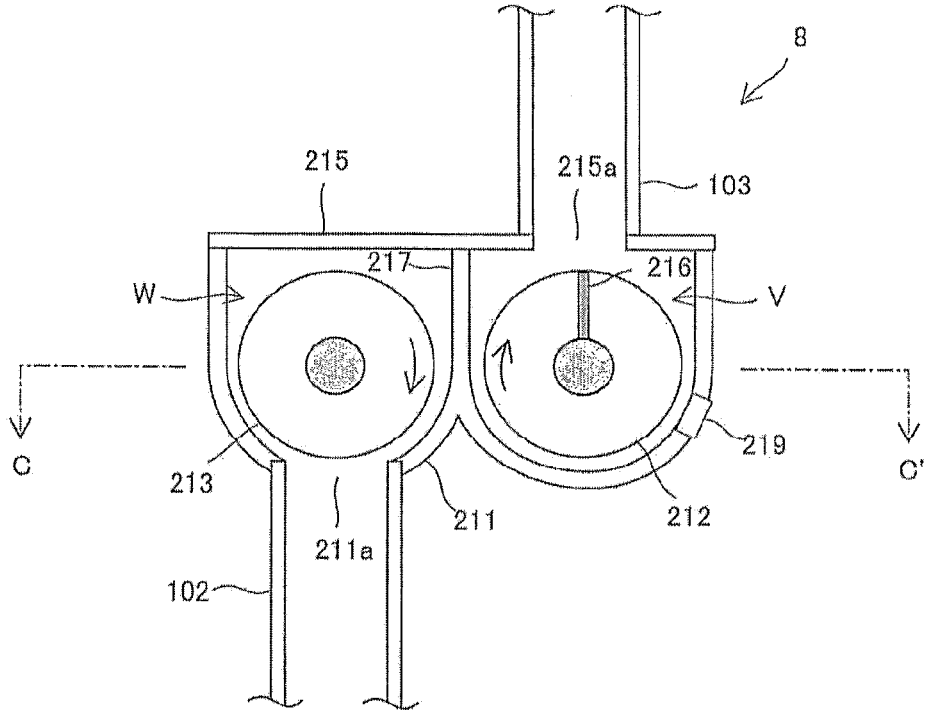
FIG. 5 is a sectional view illustrating a schematic configuration of an embodiment of an intermediate hopper of the present invention.

FIG. 5 is a schematic cross sectional view of an embodiment of the intermediate hopper of the present invention.

Figure 6:
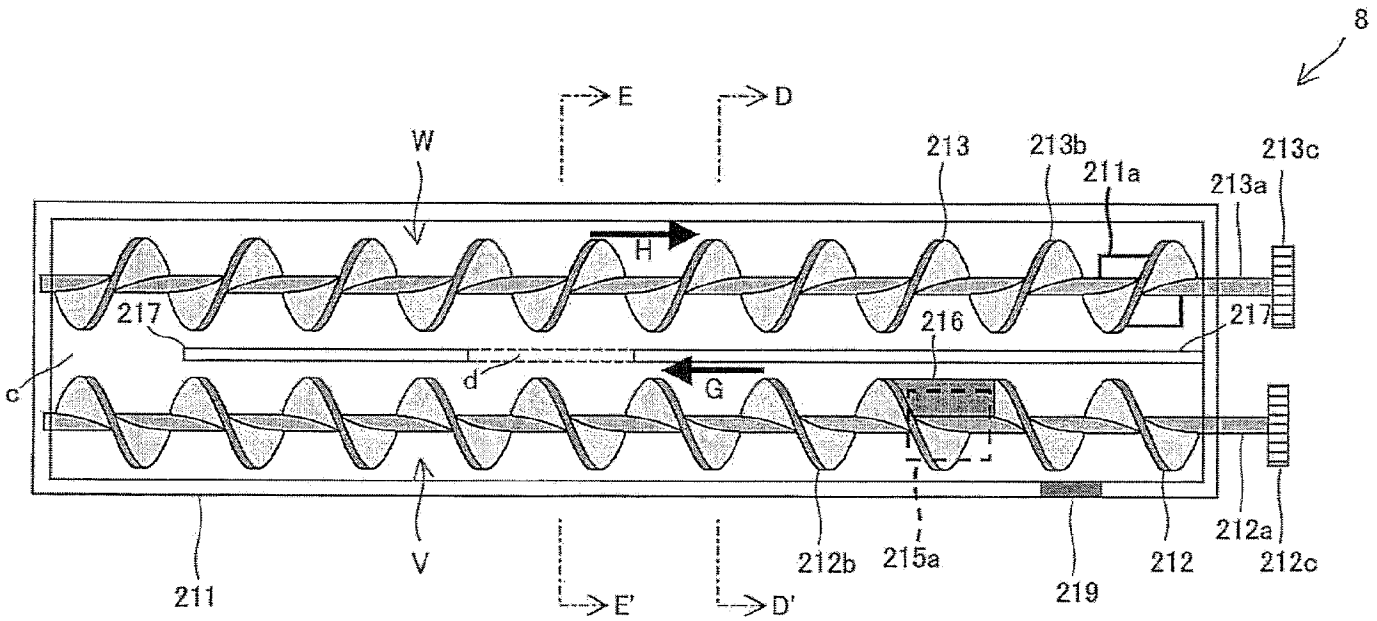
FIG. 6 is a sectional view of the intermediate hopper taken along a line C-C' in FIG. 5.

FIG. 6 is a sectional view of the intermediate hopper taken along a line C-C' in FIG. 5.

Figure 7:
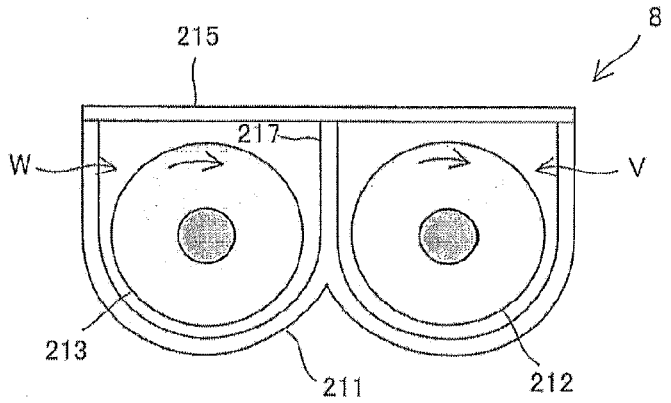
FIG. 7 is a sectional view of the intermediate hopper taken along a line D-D' in FIG. 6.

FIG. 7 is a sectional view of the intermediate hopper taken along a line D-D' in FIG. 6.

Figure 8:
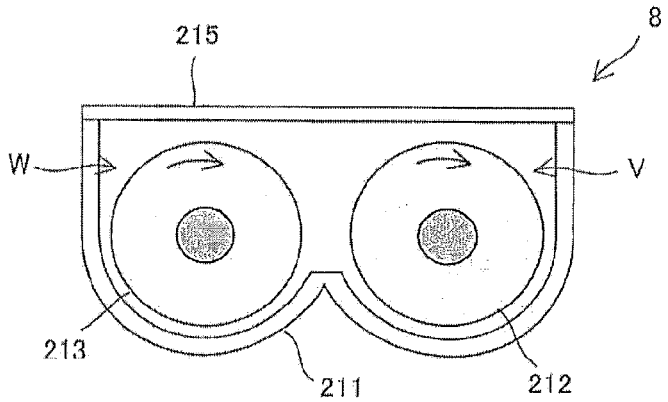
FIG. 8 is a sectional view of the intermediate hopper taken along a line E-E' in FIG. 6.

FIG. 8 is a sectional view of the intermediate hopper taken along a line E-E' in FIG. 6.

The intermediate hopper 8 is located between the toner supplying device 9 and the developing device 2, and temporarily contains the toner supplied from the toner supplying device 9, and then supplies the toner to the developing device 2.

The toner contained in the intermediate hopper 8 is not shown in these drawings.

As illustrated in FIGS. 5 to 8, the intermediate hopper 8 includes an approximate cuboid toner reception tub 211 for containing the toner, a detachable toner reception tub cover 215 constituting a top wall of the intermediate hopper, a partition 217 for dividing the toner reception tub 211 into two chambers, first and second toner conveyance paths V and W provided in the toner reception tub 211, first and second toner conveyance screws 212 and 213 rotatably provided in the first and second toner conveyance paths V and W, respectively, and a toner amount detection sensor (a piezoelectric sensor) 219.

The toner reception tub cover 215 has a toner receiving port 215*a* formed on an upstream side of a toner conveyance direction in the first toner conveyance path V (arrow G direction in FIG. 6) for receiving the toner from the toner supplying device 9.

The toner receiving port 215*a* is connected to the toner discharge port 121*a* of the toner supplying device 9 via the toner conveyance pipe 103.

The bottom of the toner containment reservoir 211 has a toner discharge port 211*a* formed on a downstream side of the second toner conveyance path W for discharging the toner.

The intermediate hopper 8 is disposed above the developing device 2 in the vertical direction (see FIG. 1), and the toner discharge port 211*a* and the toner supply port 115*a* of the development device 2 (see FIG. 2) are connected by a toner conveyance pipe 102.

The internal space of the reception tub 211 is divided into the two chambers by the partition 217. Out of the two chambers, the chamber having the toner receiving port 215*a* is the first toner conveyance path V, and the chamber having the toner discharge port 211*a* is the second toner conveyance path W.

A downstream end of the first toner conveyance path V and an upstream end of the second toner conveyance path W are communicated by a toner communicating path c.

The partition 217 has an intermediate slit d formed in a central part thereof.

The toner is usually conveyed through the toner communicating path c. When the toner in the second toner conveyance path W runs low, however, the intermediate slit d functions as a bypass for guiding the toner from the first toner conveyance path V to the second toner conveyance path W.

The intermediate slit d is an opening for guiding the toner flowing in the first toner conveyance path V toward the second toner conveyance path W.

Preferably, as illustrated in FIG. 6, the intermediate slit d is provided at a substantially central position of the partition 217 or at a position on the toner receiving port 215*a* side relative to the substantially central position of the partition 217 so that the intermediate slit d functions as a bypass when supply of toner from the toner supplying device is suspended for replacement of the toner supplying device and the toner conveyance paths have a region having no toner or a region having a low toner density (hereinafter, referred to as toner-missing space). For example, the intermediate slit d may be formed by opening the partition 217 rightward and leftward from the center by equal distances so as to give a total slit width of approximately 30 mm.

Alternatively, the intermediate slit having such a slit width may be provided on an upstream side relative to the center of the partition or on a downstream side relative to the center of the partition.

Preferably, the intermediate slit d has a slit width of approximately 20 mm to 40 mm and is formed at a position where an outer edge of a helical blade 212*b* of the toner conveyance screw 212 and an outer edge of a helical blade 213*b* of the toner conveyance screw 213 come closest to each other. The position where the outer edges of the helical blades come closest to each other means a position where the distance between the outer edges of the helical blades 212*b* and 213*b* can be the shortest when the first toner conveyance screw 212 and the second toner conveyance screw 213 rotate in synchronization at the same rotation speed, and a straight line connecting the outer edges of the two helical blades 212*b* and 213*b* and having the shortest distance is within the opening of the intermediate slit.

At the position, where the intermediate slit d is formed so that the outer edges of the helical blades (212*b* and 213*b*) of the first and second toner conveyance screws come closest to each other, the first toner conveyance screw 212 urges the toner in the first toner conveyance path V toward the partition, and at the same time, the second toner conveyance screw 213 urges the toner in the second toner conveyance path W away from the partition.

In other words, the intermediate slit d is provided at a position where a region having a toner density reduced on the partition side in the second toner conveyance path W (low-density space) coincides with a region having a toner density increased on the partition side in the first toner conveyance path V.

Accordingly, at the position of the intermediate slit d, the toner can be moved swiftly from the first toner conveyance path V to the second toner conveyance path W.

Thus, even if the amount of toner being conveyed is varied during the toner conveyance and a toner-missing space is generated in the second toner conveyance path W, an appropriate amount of toner according to the amount of toner being conveyed is supplied to the second toner conveyance path W through the intermediate slit d. As a result, the toner-missing space can be filled swiftly, and therefore the toner can be supplied to the developing device steadily.

Here, the value of the slit width of the intermediate slit d cannot be determined exclusively and may vary depending on the amount of toner to convey and the diameter of the screws (diameter of the helical blades).

Likewise, the number of the intermediate slit is not limited to one as shown in the drawings and may be two or more.

The first toner conveyance screw 212 is rotationally driven by a drive motor, not shown, and conveys, while agitating, the toner in the first toner conveyance path V in the arrow G direction.

The first toner conveyance screw 212 is an auger screw including a first rotation axis 212*a* provided horizontally and rotatably in the first toner conveyance path V, the first helical blade 212*b* fixed to the outer circumferential surface of the first rotation axis 212*a* and a first gear 212*c* provided to the first rotation axis 212*a* at one end that protrudes out of the toner reception tub 211.

The first toner conveyance screw 212 further includes a rectangular agitation plate 216 provided at a position facing the toner receiving port 215*a* so as to extend radially from the first rotation axis 212*a* and fixed in parallel with the first rotation axis 212*a*.

In the embodiment in FIGS. 5 and 6, the agitation plate 216 is provided right under the toner receiving port 215*a*.

This agitation plate 216 catches the toner which has fallen through the toner receiving port 215*a* and agitates the toner thereon. In addition, the agitation plate 216 contributes to prevention of false detection by the toner amount detection sensor 219.

Having fallen through the toner receiving port 215*a* and caught by the agitation plate 216 provided right under the toner receiving port 215*a*, the toner is rotated with the rotation of the first rotation axis 212*a* while being held between the agitation plate 216 and the first helical blade 212*b*.

The toner held between the agitation plate 216 and the first helical blade 212*b* as described above is first urged by the rotation of the agitation plate 216 toward the upstream side of the first helical blade 212*b* (toward the right on the page of FIG. 6) to be temporarily accumulated on the upstream side of the first toner conveyance path V.

When the agitation plate 216 is provided over a region corresponding to one wind of the helix of the first helical blade 212*b* as illustrated in FIG. 6, the toner is urged toward the upstream side by at least approximately one wind of the helix of the helical blade.

Then, the toner temporarily accumulated is urged by further rotation of the helical blade 212*b* toward the downstream side of the first toner conveyance path V (toward the left on the page of FIG. 6), and therefore gradually conveyed toward the downstream side (toward the left on the page of FIG. 6) through a gap between a wall surface of the first toner conveyance path V and the first helical blade 212*b*.

The toner temporarily accumulated on an upstream side relative to the position of the agitation plate 216 allows the toner amount detection sensor 219 provided on an upstream side relative to the agitation plate to always detect the toner accumulated without a gap as to be described below.

Thus, the toner amount detection sensor 219 is prevented from detecting a toner-missing space having a temporarily decreased toner density to falsely conclude that no toner is remaining and therefore enabled to accurately detect presence or absence of the toner.

As illustrated in FIG. 7, the first toner conveyance screw 212 is driven by the drive motor, not shown, so as to rotate in a direction in which the outer edge thereof moves toward the second toner conveyance path W at a lowermost point (clockwise in FIG. 7).

The second toner conveyance screw 213 is rotationally driven by a drive motor, not shown, and conveys, while agitating, the toner in the second toner conveyance path W to an arrow H direction.

The second toner conveyance screw 213 is an auger screw including a second rotation axis 213*a* provided horizontally and rotatably in the second toner conveyance path W, a second helical blade 213*b* fixed to the outer circumferential surface of the second rotation axis 213*a* and a second gear 213*c* provided to the second rotation axis 213*a* at one end that protrudes out of the toner containment reservoir 211.

As illustrated in FIG. 7, the second toner conveyance screw 213 is driven by the drive motor, not shown, so as to rotate in a direction in which the outer edge thereof moves away from the first toner conveyance path V at a lowermost point (clockwise in FIG. 7).

The toner amount detection sensor 219 detects presence or absence of the toner in the first toner conveyance path V of the toner reception tub 211. As illustrated in FIGS. 5 and 6, the toner amount detection sensor 219 is provided in a side surface of the first toner conveyance path V (toner reception tub 211) at a position on an upstream side relative to the position of the agitation plate 216 of the first toner conveyance screw 212 by one wind of the helix so that its sensing surface is exposed on the inside of the first toner conveyance path V. As the toner amount detection sensor 219, a piezoelectric sensor may be used, for example.

When the toner amount detection sensor 219 detects presence or absence of the toner and decides that no toner is remaining, the toner in the toner supplying device 9 to be described later is supplied into the first toner conveyance path V through the toner receiving port 215*a*.

Figure 9:
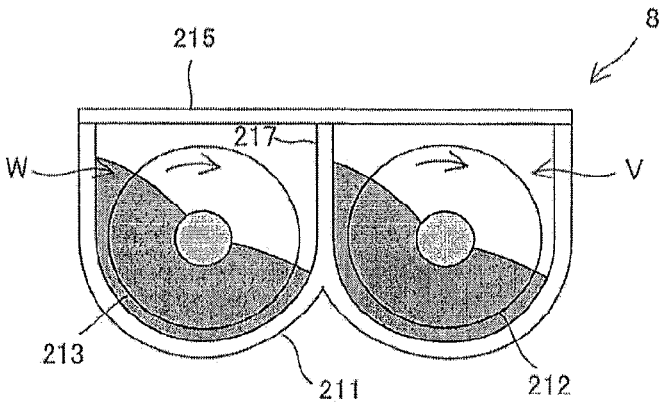
FIG. 9 is an explanatory diagram illustrating an example of toner conveyance in the intermediate hopper of the present invention.
Figure 10A:
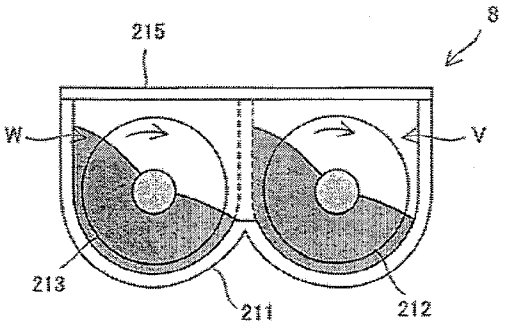
FIG. 10(*a*) is an explanatory diagram illustrating the example of toner conveyance in the intermediate hopper of the present invention.
Figure 10A:
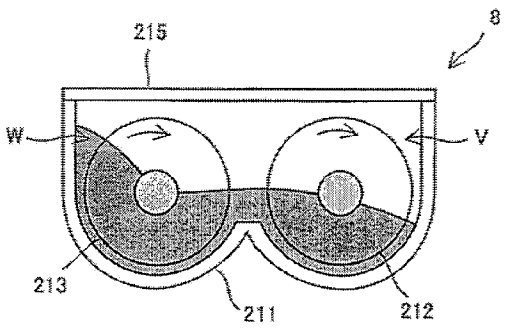
Figure 10B:
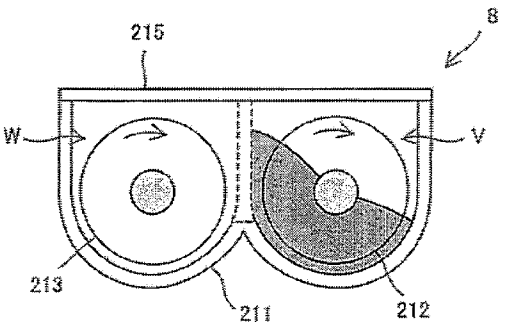
Figure 10B:
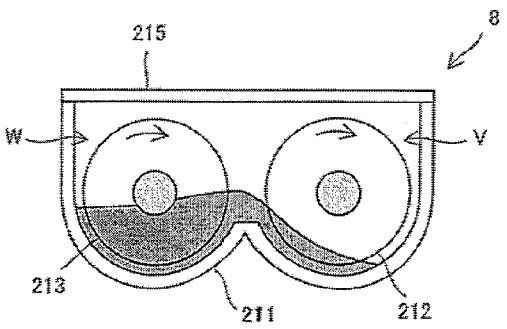

FIG. 9 is an explanatory diagram illustrating an example of toner conveyance in the intermediate hopper of the present invention.

FIG. 9 shows the example of toner conveyance at a position illustrated in FIG. 7, which is a sectional view taken along the line D-D' in FIG. 6.

As illustrated in FIG. 9, the first toner conveyance screw 212 and the second toner conveyance screw 213 rotate in arrow directions, that is, clockwise (right) in the intermediate hopper 8.

During the rotation, the helical blade 212*b* of the first toner conveyance screw 212 on the right urges the toner on the bottom of the first toner conveyance path V toward the partition 217 (leftward). Accordingly, at this position, the toner is conveyed while leaning to the partition 217 with the second toner conveyance path W.

On the other hand, the helical blade 213*b* of the second toner conveyance screw 213 on the left urges the toner on the bottom of the second toner conveyance path W away from the partition 217 (leftward). Accordingly, at this position, the toner is conveyed while leaning away from the partition 217 with the first toner conveyance path V.

FIGS. 10(*a*) and (*b*) are explanatory diagrams illustrating the example of toner conveyance in the intermediate hopper of the present invention.

FIGS. 10(*a*) and (*b*) show the example of toner conveyance at a position illustrated in FIG. 8, which is a sectional view taken along the line E-E' in FIG. 6.

This position has the intermediate slit d illustrated in FIG. 6.

FIG. 10(*a*) illustrates the case where the second toner conveyance path W is containing a sufficient amount of toner.

As illustrated in FIG. 10(*a*), when the first toner conveyance screw 212 and the second toner conveyance screw 213 rotate in the respective arrow directions in the intermediate hopper 8, the helical blade 212*b* of the first toner conveyance screw 212 urges the toner on the bottom of the first toner conveyance path V toward the second toner conveyance path W (leftward).

As illustrated in the right drawing in FIG. 10(*a*), some of the toner in the first toner conveyance path V moves to the second toner conveyance path W on the left through the intermediate slit d.

Since the second toner conveyance path W is containing a sufficient amount of toner, however, most of the toner in the first toner conveyance path V will be just conveyed in the first toner conveyance path V without moving to the second toner conveyance path W as illustrated in the right drawing in FIG. 10(*a*).

FIG. 10(*b*) illustrates the case where the second toner conveyance path W is not containing a sufficient amount of toner. For example, the case illustrated is where the toner supplying device is replaced without suspending a printing job in the image forming apparatus 100, and supply of toner into the intermediate hopper 8 is temporarily stopped. In this case, a toner-missing space is generated in the second toner conveyance path W (or in the first toner conveyance path V) as illustrated in the left drawing in FIG. 10(*b*).

When the helical blade 212*b* of the first toner conveyance screw 212 urges the toner on the bottom of the first toner conveyance path V toward the second toner conveyance path W while supply of toner from the toner cartridge is temporarily stopped to result in generation of a toner-missing space and the second toner conveyance path W has no toner as illustrated in FIG. 10(*b*), the toner in the first toner conveyance path V moves to the second toner conveyance path W (leftward) through the intermediate slit d.

That is, the toner is supplied from the first toner conveyance path V to the toner-missing space through the intermediate slit d.

Thus, the toner-missing space in the second toner conveyance path W is swiftly filled as illustrated in the right drawing in FIG. 10(*b*).

By providing the intermediate slit d to the partition and rotating the first and second toner conveyance screws as described above, it is possible to prevent the toner from flowing backward from the second toner conveyance path to the first toner conveyance path, and therefore it is possible to efficiently convey the toner from the first toner conveyance path to the second toner conveyance path.

In addition, even when a toner-missing space is generated temporarily in the intermediate hopper, the toner-missing space can be swiftly filled, so that the toner can be supplied to the developing device steadily.

According to the present invention, the agitation plate is provided at a position facing the toner receiving port and the toner amount detection sensor is provided on an upstream side relative to the agitation plate so that the toner supplied through the toner receiving port is temporarily accumulated and the toner amount detection sensor detects the toner accumulated without a gap. Thus, it is possible to accurately detect presence or absence of the toner and to prevent false detection of the toner.

In addition, the partition is provided with the intermediate slit, and therefore, even when a toner-missing space is generated in the toner conveyance paths of the intermediate hopper during replacement of the toner supplying device, the toner can be supplied to the toner-missing space through the intermediate slit to swiftly fill the toner-missing space. Thus, it is possible to steadily supply toner to the developing device.

What is claimed is:

1. An intermediate hopper comprising:

a toner reception tub for containing a toner;

a partition for dividing an internal space of the toner reception tub;

a first toner conveyance path and a second toner conveyance path separated by the partition;

a first toner conveyance screw being provided in the first toner conveyance path and comprising a first rotation axis and a first helical blade fixed to the first rotation axis, wherein the first toner conveyance screw rotates in a direction in which an outer edge of the first toner conveyance screw moves toward the second toner conveyance path at a lowermost point;

a second toner conveyance screw being provided in the second toner conveyance path and comprising a second rotation axis and a second helical blade fixed to the second rotation axis, wherein the second toner conveyance screw rotates in a direction in which an outer edge of the second toner conveyance screw moves away from the first toner conveyance path at a lowermost point;

a toner receiving port provided on an upstream side of the first toner conveyance path for receiving the toner into the toner reception tub;

a toner communicating path for communicating a downstream end of the first toner conveyance path and an upstream end of the second toner conveyance path, and guiding the toner in the first toner conveyance path to the second toner conveyance path;

a toner discharge port provided on a downstream side of the second toner conveyance path for discharging the toner out of the toner reception tub; and a toner amount detection sensor for detecting presence or absence of the toner in the first toner conveyance path, wherein the first toner conveyance screw further comprises an agitation plate disposed at a position facing the toner receiving port so as to extend radially from the first rotation axis and fixed in parallel with the first rotation axis, and the toner amount detection sensor is provided on an upstream side relative to the agitation plate, and wherein the partition comprises an intermediate slit for guiding the toner contained in the first toner conveyance path to the second toner conveyance path, and wherein the intermediate slit is formed at a position where the outer edges of the helical blades of the first toner conveyance screw and the second toner conveyance screw come closest to each other.

2. An image forming apparatus comprising:

a photoconductor drum having a surface on which an electrostatic latent image is formed;

a charger for charging the surface of the photoconductor drum;

an exposure device for forming the electrostatic latent image on the surface of the photoconductor drum;

a developing device for supplying a toner to the electrostatic latent image on the surface of the photoconductor drum to form a toner image;

the intermediate hopper according to claim 1 for supplying the toner to the developing device;

a toner supplying device for supplying the toner to the intermediate hopper;

a transfer device for transferring the toner image formed on the surface of the photoconductor drum onto a recording medium; and a fixing device for fixing the transferred toner image on the recording medium.

* * * * *